US007305739B2

(12) United States Patent
Gombash, Jr.

(10) Patent No.: US 7,305,739 B2
(45) Date of Patent: Dec. 11, 2007

(54) APPARATUS FOR TOW OPENING

(75) Inventor: Joseph D. Gombash, Jr., Matthews, NC (US)

(73) Assignee: Celanese Acetate, LLC, Rock Hill, SC (US)

( * ) Notice: Subject to any disclaimer, the term of this patent is extended or adjusted under 35 U.S.C. 154(b) by 437 days.

(21) Appl. No.: 10/941,716

(22) Filed: Sep. 15, 2004

(65) Prior Publication Data

US 2006/0053593 A1 Mar. 16, 2006

(51) Int. Cl.
*D01G 37/00* (2006.01)

(52) U.S. Cl. ..... 19/66 T

(58) Field of Classification Search ..... 19/66 R, 19/66 T

See application file for complete search history.

(56) References Cited

U.S. PATENT DOCUMENTS 3,032,829 A 5/1962 Mahoney et al.
3,156,016 A 11/1964 Dunlap et al.
3,226,773 A 1/1966 Paliyenko
3,714,685 A * 2/1973 Yarber ..... 28/279
4,179,776 A * 12/1979 Wortman ..... 28/121
4,464,815 A * 8/1984 Canterino et al. ..... 26/72
5,201,424 A * 4/1993 Hain ..... 209/534
5,316,798 A * 5/1994 Tittgemeyer ..... 427/409
5,356,129 A * 10/1994 Godlewski ..... 271/212
6,543,106 B1 * 4/2003 Ames et al. ..... 28/283

OTHER PUBLICATIONS

U.S. Appl. No. 09/219,818, filed Dec. 23, 1998, Ames et al.
U.S. Appl. No. 10/672,519, filed Sep. 26, 2003, Ames et al.

* cited by examiner

*Primary Examiner*—Shaun R. Hurley
(74) *Attorney, Agent, or Firm*—Hammer & Hanf, P.C.

(57) ABSTRACT

An apparatus for opening a crimped multifilament tow comprising: a source of crimped multifilament tow; at least one pair of opposed gripping rollers comprising a first roller which is a metal roller and a second roller which is a smooth-surfaced roller made of a material selected from the group consisting of: polyurethane or silicone rubber; where the multifilament tow passes between and in contact with both of the rollers and filaments of the tow are separated from one another and opened.

18 Claims, 1 Drawing Sheet

APPARATUS FOR TOW OPENING

BACKGROUND OF THE INVENTION

This application relates to an apparatus and process for opening filamentary tows with a total denier of less than 200,000 such tows being any synthetic polymer tow, for example polyolefin, polyester and cellulosics. The opened filamentary tows are generally employed in the manufacture of cigarette filters and absorbent cores.

The filamentary tow is delivered in highly compacted bales. For use, the tow must be opened, i.e., the maximum amount of fiber surfaces exposed. Tow opening involves the separation of the individual filaments one from another.

FIG. 4 illustrates a conventional tow opening apparatus. First, the tow band 15 is pulled by roller pair 5, 6 and 7, 8 from the bale 10 through an air spreader or banding jet 20 which serves to straighten the tow band, to remove any twist, and to perform a preliminary filament separation. Second, this pre-opened band 25 that still contains fully unseparated filaments is fed to an opening system which completes opening (i.e., the filament separation). Liquid plasticizer or bonding agent or other liquid materials 65 may be added to the tow as part of the opening process.

An opening system separates the filaments by the mechanical action that occurs between two pairs of rollers 5, 6 and 7, 8. The second pair of rollers 7, 8 is driven at a slightly faster speed than the first 5, 6. Roller pair 5, 6 may or may not be driven. One roller of each pair has a solid rubber surface, while the second roller of each pair has a metal surface that may be smooth or textured (i.e., grooved or threaded), preferably textured. Each solid rubber surface of this prior art is either a natural rubber or a nitrile rubber. The effect is that small groups of filaments are alternately tensioned and relaxed in a shuffling fashion between the roller pairs resulting in complete separation of the individual filaments. The opened or separated band 55 is then spread to its final width by another banding jet or a forming jet 60 and fed on to a subsequent forming apparatus.

Two end uses for opened tow, such as cellulose acetate, are cigarette filters and absorbent cores for personal hygiene garments (e.g., diapers, training pants, incontinent pads, sanitary napkins and the like).

More information on filter rodmaking can be found in the book entitled, THE DESIGN OF CIGARETTES by Colin L. Browne, copyright 1990. U.S. Pat. Nos. 3,032,829 and 3,156,016 discuss a process and apparatus for opening filamentary tows.

The existing art and practice of opening ("blooming" or "de-registering") a cellulose acetate tow band utilizes one or more hard rubber rollers in the opening rolls. The rubber is a natural rubber or a rubber defined as a nitrile rubber.

These rubber rollers are subject to wear, resulting in variability in the opened tow and must be periodically changed. Accordingly, there is a need to improve the rubber rollers to reduce variability of the opened tow products.

SUMMARY OF THE INVENTION

An apparatus for opening a crimped multifilament tow comprising: at least one pair of opposed gripping rollers comprising a first roller which is a metal roller and a second roller which is a smooth-surfaced roller made of a material selected from the group consisting of: polyurethane or silicone rubber.

BRIEF DESCRIPTION OF THE DRAWINGS

Some of the embodiments of the invention are described with respect to the accompanying drawings in which.

DETAILED DESCRIPTION OF THE INVENTION

Multifilamentary tow as used herein refers to any tow with a total denier of less than 200,000, particularly 100,000 or less. Filamentary tows may include any synthetic polymer tow such as, for example, polyolefins (e.g. polyethylene, polypropylene), polyester (e.g. PET, PBT), cellulosics (e.g. rayon, cellulose ester (e.g. cellulose acetate) cellulose ethers), preferred are cellulose acetate tows.

Figure 1:
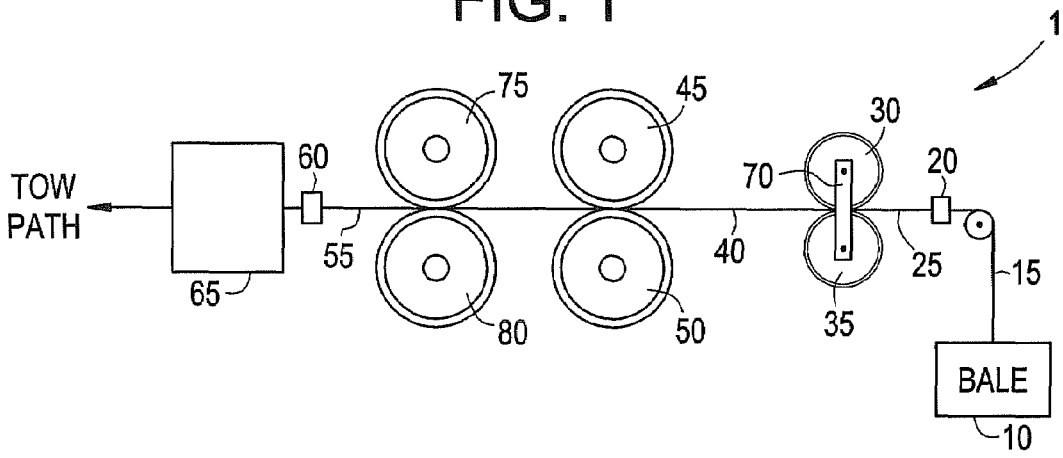
FIG. 1 illustrates a schematic elevation view of a tow opening apparatus.

Referring now to the drawings where like numerals indicate like elements, there is shown in FIG. 1 a tow opening device 1. Device 1 comprises a banding jet 20, a pair of tensioning rollers 30, 35, a pair of first opening rollers (feed rollers) 45, 50, a pair of second opening rollers (ratio rollers) 75, 80, a second banding jet 60, and an optional liquid application device 65.

Tow 15 is pulled from bale(s) 10 through the banding jet 20 and tension rollers 30, 35 by the first opening roller pair 45, 50. Then the tow is delivered from the first opening roller pair 45, 50 to the second opening roller pair 75, 80. Opening of the tow 40 occurs between the first and second roller pairs. The opened tow is then fed to the second banding jet 60 and, if desired, through the liquid application device 65.

In FIG. 1, tow travel is shown in a horizontal plane, but it is not so limited. Tow travel may be vertical or at any angle by the proper arrangement of roller pairs.

Banding jets 20 and 60 are conventional. Banding jets 20, 60 are used to spread tow. To spread means to increase the width (cross machine direction). Typically the banding jet is an air spreader. Exemplary banding jets are illustrated in U.S. Pat. No. 3,226,773 or U.S. patent application Ser. No. 09/219,818 filed Dec. 23, 1998 and Ser. No. 10/672,519 filed Sep. 26, 2003, all of which are incorporated herein by reference.

The tensioning roller pair 30, 35 is conventional. Preferably, at least one of the rollers is elastically surfaced. Pair 30, 35 may be driven so as to pull the tow 15 from the bale 10. A gap (or nip) in the roller pair may be adjustable along a yoke 70. If any of the rollers 30, 35 is elastically surfaced then it may have a surface material selected from the group consisting of: polyurethane rubber or silicone rubber.

Liquid application device 65 is optional and conventional. Device 65 is used for applying a liquid to the opened tow. Applying refers to spraying, dipping or the like, of liquid to the tow. The liquid may be, for example, a plasticizer used to bond the filaments of the tow together. Plasticizers for cellulose acetate are conventional, e.g. triacetin.

First opening roller pair 45, 50 and second opening roller pair 75, 80 work together to open the coherent tow 15. First opening roller pair 45, 50 consists of an upper roller 45 and a lower roller 50. Upper roller 45 may be a smooth faced metal or a textured metal, preferably a textured metal roller.

Textured metal rollers will be discussed in greater detail below. Lower roller 50 is a smooth faced rubber roller. The rubber face of this roller will be discussed below in greater detail. Second opening roller pair 75, 80 consists of an upper roller 75 and a lower roller 80. Upper roller 75 may be either a smooth faced metal roller or a textured metal roller, preferably a textured metal roller. Lower roller 80 is a smooth faced rubber roller. The rubber face of this roller will be discussed below in greater detail. Of course, the rollers may be inverted, (i.e. rubber faced rollers placed on top and metal faced rollers placed on bottom), or have a staggered placement, (i.e. one metal roller on top, one rubber faced roller on top). This apparatus either has a means for driving only one of the rollers of the roller pairs 45, 50 and 75, 80, the other roller being biased toward one another so that the roller which is not driven is also caused to rotate, or a means for driving both of the rollers, the former is preferred.

In operation, the second roller pair 75, 80 is driven faster than the first roller pair 45, 50. This roller speed differential causes the coherent filaments of the tow 40 to open (or bloom or deregister), as is well known in the art. See U.S. Pat. Nos. 3,032,829 and 3,156,016 incorporated herein by reference.

Figure 2:
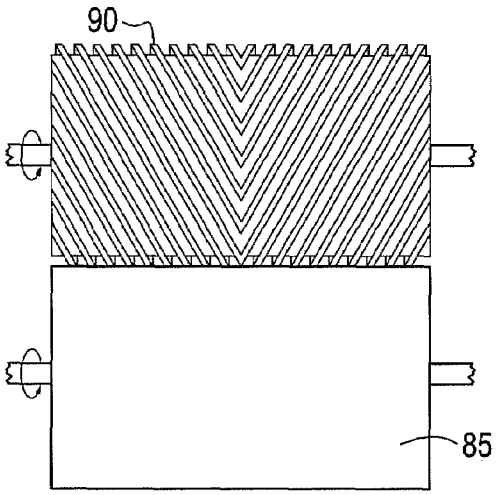
FIG. 2 is a fragmentary elevational view of one of the sets of rollers of the tow opening system.

Textured metal roller is shown in FIG. 2, 90. The meaning of textured as it is used throughout this application means: grooved; threaded; ridged; helically threaded; parallel circular rings; parallel elliptical rings; embossed patterns; carved patterns; helically threaded for half their lengths in a counter-clockwise direction and for the other half in a clockwise direction where the base of each grove is v-shaped, u-shaped, etc. whereas the tops of the ridges separating adjacent grooves are slightly flattened; or any arrangement of protrusions and indentations which would give the roller a textured (as opposed to a smooth) surface. In one of the embodiments of this apparatus the metal rollers are textured. In another embodiment of this apparatus the metal rollers are threaded.

The rubber faced rollers 50, 80, and 85 have a surface material selected from the group consisting of: polyurethane rubber or silicone rubber. One embodiment uses polyurethane as the material of the smooth surface rollers 50, 80, and 85 FIGS. 1 and 2. The polyurethane chosen for this application may be a food grade material. In one of the embodiments this polyurethane would be resistant to acetone and glycerol triacetate. Polyurethane does not degrade (harden) with UV as dies the industry standard nitrile rubber. Polyurethane rollers are produces from mixed liquids and are more uniform than nitrile rubber rollers which are produced from mixed solids. In the embodiments that use polyurethane rollers, the rollers may be solid polyurethane rollers or have polyurethane covers. An example of a polyurethane which may be used is D2747, commonly available from Winfield Industries, Inc. 852 Kensington Ave. Buffalo, N.Y. 14215.

In one of the embodiments of this invention the polyurethane has a Shore A hardness of 45 to 85, while in another embodiment Shore A hardness is equal to or between 60 to 70. In choosing the proper polyurethane to be used in this application, in one embodiment of this invention, the polyurethane selected has an elongation of between 350 to 550%. Elongation as referred to here is measured according to ASTM D412 test method. In another embodiment the polyurethane has a tensile strength at 100% modulus psi (pounds per square inch) of between 200 to 600 (or 14.1 to 42.2 kilogram-force/square centimeter). Another embodiment has a tensile strength at break of 1500-3000 psi (or 105.5 to 210.9 kilogram-force/square centimeter). The mechanical properties referred to here would be measured according to ASTM D412 test method.

Silicone rubber may be used, in another embodiment of this invention, as the material of the smooth surface rollers 50, 80. In one of the embodiments of this invention the silicone rubber has a Shore A hardness of 40 to 90. In choosing the proper silicone rubber to be used in this application, in one embodiment of this invention, the silicone rubber selected would have an elongation of between 350 to 550%. In another embodiment the elongation is between 385 to 540%. Elongation as referred to here would be measured according to ASTM D412 test method. In another embodiment of the invention the silicone rubber has a tensile strength at 100% Modulus psi of, between 200 to 600 (or 14.1 to 42.2 kilogram-force/square centimeter). The mechanical properties referred to here would be measured according to ASTM D412 test method. In the embodiments that use silicone rubber rollers, the rollers may be solid silicone rubber rollers or silicone rubber roller covers. These silicone rollers may be obtained from Winfield Industries, Inc., 852 Kensington Ave, Buffalo, N.Y. 14215.

Figure 3:
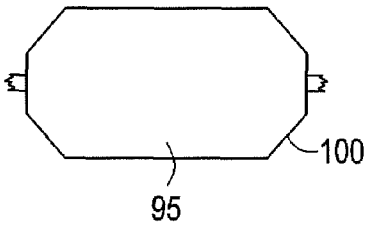
FIG. 3 is an elevational view of the smooth roller illustrating a chamfered edge.
Figure 4:
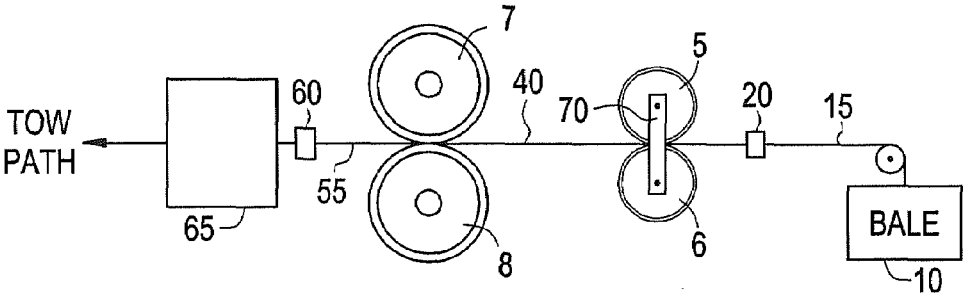
FIG. 4 (PRIOR ART)
FIG. 4 illustrates a schematic elevational view of a prior art opening apparatus.

A chamfered or beveled edge 100, FIG. 3, is another embodiment of the present invention in the smooth surface roller, 95. This chamfered or beveled edge helps in preventing edge damage in this application.

An antistatic component can be used in another embodiment of the invention, to reduce static. This antistatic component is added to either the polyurethane or silicone rubber before it is fashioned into a roller or roller surface. One example of a compound that can be used to reduced static is carbon black. Other examples are compounds selected from the group consisting of: fatty acid esters, ethoxylated amines, alkyl sulfonates and mixtures thereof. Reduction of static means a better performance of the opening system. Such antistatic components are known, for example, see Plastics Additives Handbook, $5^{th}$ Edition Hauser publishers, Munich Germany, 2001, chapter 10 incorporated herein by reference.

Tow opening devices may be used in the manufacture of cigarette filters, (see THE DESIGN OF CIGARETTES by Colin L. Browne, copyright 1990, incorporated herein by reference) or may be used in the manufacture of absorbent cores (see U.S. patent application Ser. No. 10/672,519 incorporated herein by reference). This invention can be used in any of a variety of commercially available tow opening machines such as the Hauni AF-2, where the nitrile rubber rollers are replaced with smooth-surfaced rollers made of a material selected from the group consisting of: polyurethane or silicone rubber.

The invention also comprises a process of opening a coherent multifilament tow comprising the steps of: providing a source of crimped multifilament tow; advancing said tow; gripping said tow at a plurality of points, each of said points being defined by a pair of opposite surfaces, one textured and one smooth or both smooth, the smooth surface(s) being made of a material selected from the group consisting of: polyurethane or silicone rubber; where the pair of opposite surfaces are spaced from one another; and separating filaments of said tow.

What is claimed is:

1. An apparatus for opening a crimped multifilament tow comprising:

at least one pair of opposed gripping rollers comprising a first roller which is a metal roller and a second roller which is a smooth-surfaced roller made of a material having an elongation of between 350-550% and a tensile strength at 100% modulus of between 200 to 600 psi and being selected from the group consisting of: polyurethane or silicone rubber;

where said multifilament tow passes between and in contact with both said rollers and filaments of said tow are separated from one another and opened.

2. The apparatus for opening crimped multifilament tow according to claim 1 where the material of the smooth surface roller is a polyurethane.

3. The apparatus for opening crimped multifilament tow according to claim 2 where the smooth surface polyurethane roller has chamfered edges.

4. The apparatus for opening crimped multifilament tow according to claim 2 where said polyurethane has a Shore A hardness of 45 to 85.

5. The apparatus for opening crimped multifilament tow according to claim 1 where said material further comprises an antistatic component.

6. The apparatus for opening crimped multifilament tow according to claim 1 where said metal roller is selected from the group consisting of: smooth surface metal rollers or textured metal rollers.

7. The apparatus for opening crimped multifilament tow according to claim 6 where said textured metal roller is selected from the group consisting of: grooved; threaded; ridged; helically threaded; parallel circular rings; parallel elliptical rings; embossed patterns; carved patterns; helically threaded for half their lengths in a counter-clockwise direction and for the other half in a clockwise direction where the base of each grove is v-shaped, u-shaped, where the tops of the ridges separating adjacent grooves are slightly flattened; or any arrangement of protrusions and indentations which would give the roller a textured surface.

8. The apparatus for opening crimped multifilament tow according to claim 1 further comprising a second pair of opposed gripping rollers comprising a first roller which is a metal roller and a second roller which is a smooth-surfaced roller made of a material selected from the group consisting of: polyurethane or silicone rubber.

9. The apparatus for opening crimped multifilament tow according to claim 8 where said metal roller is selected from the group consisting of: smooth surface metal rollers or textured metal rollers.

10. The apparatus for opening crimped multifilament tow according to claim 9 where said textured metal roller is selected from the group consisting of: grooved; threaded; ridged; helically threaded; parallel circular rings; parallel elliptical rings; embossed patterns; carved patterns; helically threaded for half their lengths in a counter-clockwise direction and for the other half in a clockwise direction where the base of each grove is v-shaped, u-shaped, where the tops of the ridges separating adjacent grooves are slightly flattened; or any arrangement of protrusions and indentations which would give the roller a textured surface.

11. The apparatus for opening crimped multifilament tow according to claim 8 further comprising a third pair of opposed rollers selected from the group consisting essentially of: a first roller which is a smooth-surfaced metal roller and a second roller which is a smooth-surfaced roller made of a material selected from the group consisting of polyurethane or silicone rubber; two smooth-surfaced rollers made of a material selected from the group consisting of polyurethane or silicone rubber; two smooth-surfaced metal rollers.

12. The apparatus for opening crimped multifilament tow according to claim 1 where said multifilament tow is selected from the group consisting of: polyolefin, polyester or cellulosics.

13. The apparatus for opening crimped multifilament tow according to claim 12 where said multifilament tow is cellulose acetate.

14. The apparatus for opening crimped multifilament tow according to claim 12 where said multifilament tow has a denier equal to or less than 200,000.

15. The apparatus for opening crimped multifilament tow according to claim 2 where said polyurethane has a tensile strength at break of between 1500 psi to 3000 psi.

16. An apparatus for opening a crimped multifilament cellulose acetate tow comprising:

at least one pair of opposed gripping rollers comprising a first roller which is a metal roller and a second roller which is a smooth-surfaced roller made of a material having an elongation of between 350-550% and a tensile strength at 100% modulus of between 200 to 600 psi and being selected from the group consisting of: polyurethane or silicone rubber;

where said multifilament cellulose acetate tow passes between and in contact with both said rollers and filaments of said cellulose acetate tow are separated from one another and opened.

17. A process of opening a coherent multifilament tow comprising the steps of:

providing a source of crimped multifilament tow;

advancing said tow;

gripping said tow at a plurality of points, each of said points being defined by a pair of opposite surfaces, one textured and one smooth, the smooth surface being made of a material having an elongation of between 350-550% and a tensile strength at 100% modulus of between 200 to 600 psi and being selected from the group consisting of: polyurethane or silicone rubber; where said pair of opposite surfaces are spaced from one another; and separating filaments of said tow.

18. A process of opening a coherent multifilament tow comprising the steps of:

providing a source of crimped multifilament tow;

advancing said tow;

gripping said tow at a plurality of points, each of said points being defined by a pair of opposite smooth surfaces, both smooth surfaces being made of a material having an elongation of between 350-550% and a tensile strength at 100% modulus of between 200 to 600 psi and being selected from the group consisting of: urethane and silicone rubber; where said pair of opposite surfaces are spaced from one another; and separating filaments of said tow.

* * * * *